US008066534B1

(12) United States Patent
Lin

(10) Patent No.: US 8,066,534 B1
(45) Date of Patent: Nov. 29, 2011

(54) PROBE CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/089,297

(22) Filed: Apr. 18, 2011

(51) Int. Cl.
*H01R 13/24* (2006.01)

(52) U.S. Cl. ..... 439/700

(58) Field of Classification Search ..... 439/824, 439/700, 289, 482; 320/755.05
See application file for complete search history.

(56) References Cited

U.S. PATENT DOCUMENTS 6,340,320 B1 * 1/2002 Ogawa ..... 439/824
7,021,976 B2 * 4/2006 Sekiguchi ..... 439/824
7,201,613 B2 * 4/2007 Sasaki ..... 439/700
7,717,756 B1 * 5/2010 Yin et al. ..... 439/700

* cited by examiner

*Primary Examiner* — Phuong Dinh

(57) ABSTRACT

A probe connector includes a pedestal shell having a pedestal platform and a barrel extending upward from the pedestal platform with a fastening body protruded outward at a top of the barrel, a positioning shell removably coupled to the fastening body and having a blocking plate covered on the top of the barrel and side plates abutting against outsides of the fastening body, a probe pin movably restrained in the barrel by the blocking plate and further projecting upward out of the blocking plate, and an elastic element assembled between the probe pin and the pedestal platform. Two windows are opened at two opposite parts of the fastening body. Two opposite side plates are provided with two contact arms extending downward and inclined towards each other to pass through the windows and always resist against the probe pin to clip the probe pin therebetween.

5 Claims, 3 Drawing Sheets

PROBE CONNECTOR

BACKGROUND OF THE INVENTION

1. Field of the Invention

The present invention relates to a connector, and more particularly to a probe connector.

2. The Related Art

A traditional probe connector includes a shell, an elastic element and a probe pin. The probe pin has a cylindrical base portion and a touching portion protruding upward from a middle of a top of the base portion. The shell is made of metal material, and has a hollow barrel looped from a metal plate and having a top end opened freely. In assembly, the elastic element is disposed in the barrel, and the base portion of the probe pin is inserted downward in the barrel, wherein two opposite ends of the elastic element abut against a bottom of the base portion and a bottom side of the barrel. Then an auxiliary jig is used to make a periphery edge of the top end of the barrel shrunk inward so as to block the base portion in the barrel. The touching portion projects out of the top end of the barrel for contacting a mating terminal.

However, after the base portion of the probe pin and the elastic element are assembled in the barrel, the periphery edge of the top end of the barrel needs be shrunk inward by the auxiliary jig. So the probe connector has a complicated assembly process, and accordingly, it is hard to disassemble the probe connector on account of the foregoing assembly manner. Furthermore, in the process of the touching portion being contacted with and pressed by the mating terminal, the base portion of the probe pin may sway randomly in the barrel so that is apt to cause a bad connection between the probe pin and the barrel.

SUMMARY OF THE INVENTION

An object of the present invention is to provide a probe connector including a pedestal shell, a positioning shell, a probe pin and an elastic element. The pedestal shell has a pedestal platform, and a hollow barrel extending upward from a top of the pedestal platform. A receiving chamber is defined among the pedestal platform and the barrel with a top end thereof opened freely. A top end of the barrel protrudes outward to form a fastening body. A pair of windows is opened at two opposite parts of the fastening body and penetrates through the fastening body and the barrel to communicate with the receiving chamber. The positioning shell is removably coupled to the fastening body of the pedestal shell. The positioning shell has a blocking plate covered on the top end of the receiving chamber, and side plates extending downward from periphery edges of the blocking plate to abut against outsides of the fastening body. A middle of the blocking plate defines a through hole having a smaller diameter than that of the receiving chamber and coaxial with the receiving chamber. Two opposite ones of the side plates are provided with two contact arms each having a top end connected with the side plate. The contact arms extend downward and are inclined towards each other to pass through the windows of the pedestal shell respectively and stretch into the receiving chamber. Each contact arm has a bottom end thereof bent outward. The probe pin has a base portion movably disposed in the receiving chamber of the pedestal shell, and a touching portion protruding upward from a middle of a top of the base portion to pass through the through hole of the positioning shell. The contact arms of the positioning shell always resist against the base portion to clip the base portion therebetween in the process of the base portion moving upward and downward in the receiving chamber. The elastic element is assembled in the receiving chamber and between the base portion and the pedestal platform. The top of the base portion resists against the blocking plate under the elasticity of the elastic element and is blocked under the blocking plate.

As described above, the probe connector of the present invention utilizes the positioning shell to be removably coupled to the fastening body of the pedestal shell and partially cover the receiving chamber, so as to make the base portion of the probe pin movably restrained in the receiving chamber. So the probe connector can be easily assembled and disassembled. Furthermore, the contact arms of the positioning shell are designed to always resist against the base portion, so that effectively ensures a steady movement of the base portion in the receiving chamber and further achieves a steadily electrical connection among the probe pin, the pedestal shell and the positioning shell.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
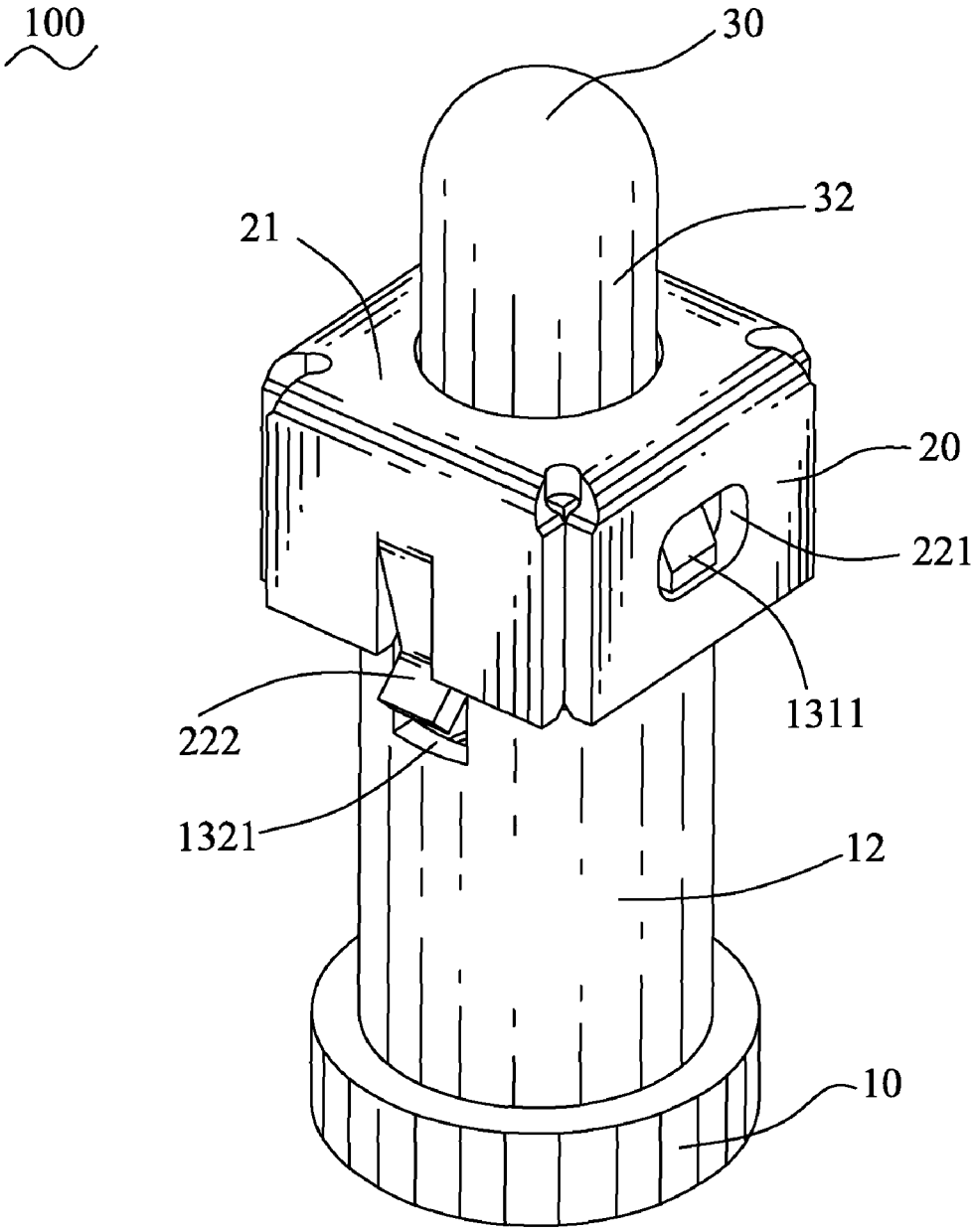
FIG. 1 is an assembled perspective view of a probe connector according to an embodiment of the present invention.
Figure 2:
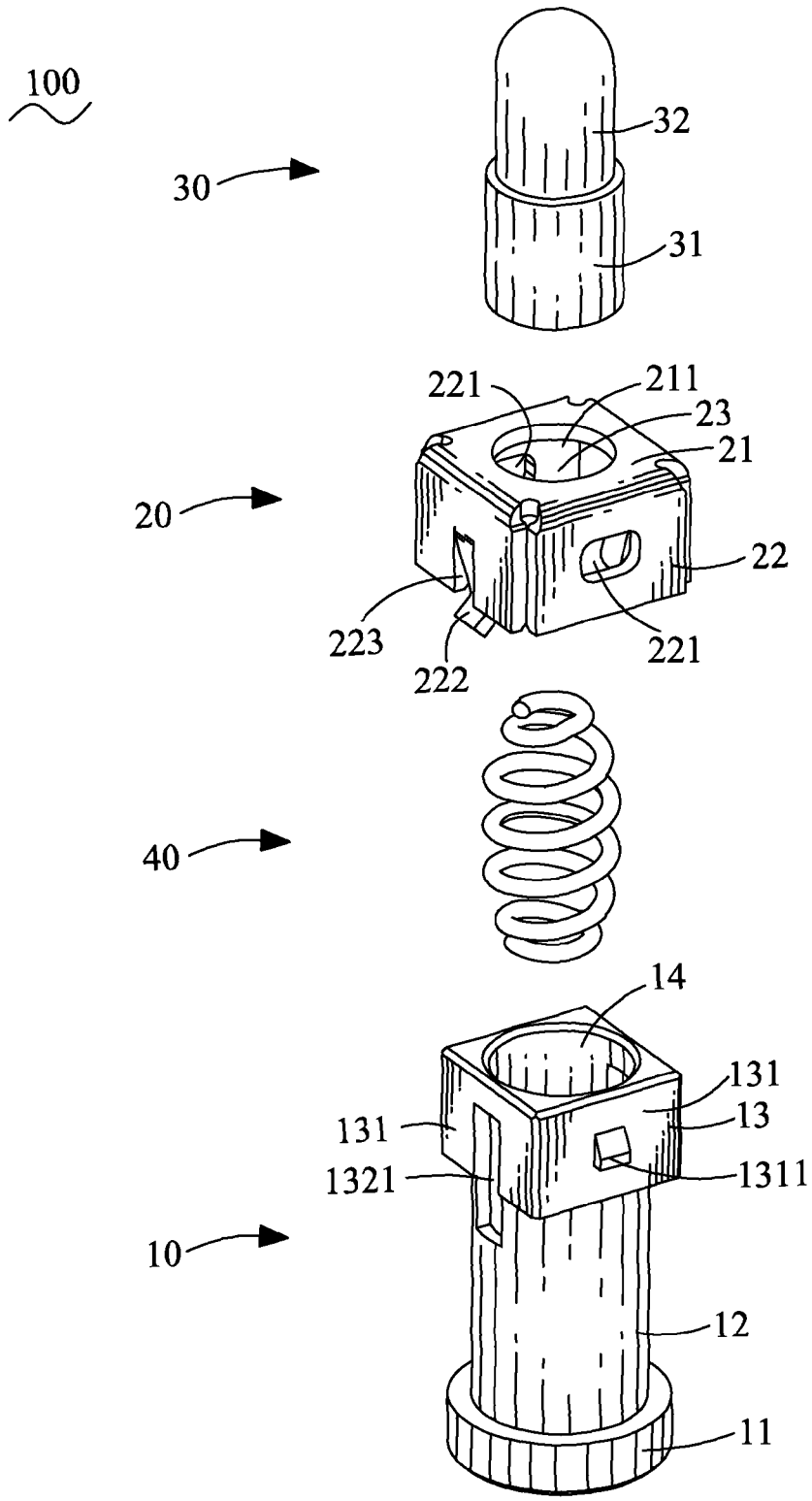
FIG. 2 is an exploded perspective view of the probe connector of FIG. 1.

With reference to FIG. 1 and FIG. 2, a probe connector 100 according to an embodiment of the present invention includes a pedestal shell 10, a positioning shell 20, a probe pin 30 and an elastic element 40.

Referring to FIG. 2 again, the pedestal shell 10 is made of metal material. The pedestal shell 10 has a pedestal platform 11, and a hollow and cylindrical barrel 12 perpendicularly extending upward from a substantial middle of a top of the pedestal platform 11 and having a top end opened freely. Accordingly, there is a receiving chamber 14 formed among the pedestal platform 11 and the barrel 12. An outside periphery of the top end of the barrel 12 protrudes outward to form a fastening body 13. In this embodiment, the fastening body 13 shows a rectangular profile and has four rectangular surfaces 131 connected in succession together. Two opposite ones of the four surfaces 131 have two substantial middles thereof oppositely protruded outward to form a pair of buckling blocks 1311. A pair of windows 1321 is opened in substantial middles of the other two opposite surfaces 131 respectively, and each extends along a generatrix direction of the barrel 12 to the barrel 12. The windows 1321 are aligned with each other along a diameter direction of the barrel 12, and further penetrate through the barrel 12 along the diameter direction of the barrel 12 to communicate with the receiving chamber 14.

The positioning shell 20 has a rectangular and flat blocking plate 21 capable of being conveniently sucked by a SMT machine. Four periphery edges of the blocking plate 21 extend downward to form four side plates 22 perpendicular to the blocking plate 21. A receiving space 23 is formed among the blocking plate 21 and the four side plates 22. A middle of the blocking plate 21 defines a circular through hole 211 having a smaller diameter than that of the receiving chamber 14 of the pedestal shell 10. The through hole 211 vertically penetrates through the blocking plate 21 and is connected with the receiving space 23. Two opposite ones of the four side plates 22 have substantial middles thereof respectively defining a buckling hole 221 which communicates with the receiving space 23. A pair of gaps 223 is opened at middles of lower portions of the other two opposite side plates 22, and each penetrates through a bottom and two opposite sides of the corresponding side plate 22. A top side of each gap 223 extends downward and is further inclined into the receiving space 23 in process of extending downward to form a contact arm 222 having a free end bent outward and oppositely to the receiving space 23.

The probe pin 30 has a cylindrical base portion 31 and a touching portion 32 protruding upward from a middle of a top of the base portion 31, wherein the touching portion 32 has a diameter corresponding to the one of the through hole 211 of the positioning shell 20, and the base portion 31 has a diameter greater than that of the through hole 211 and corresponding to the one of the receiving chamber 14 of the pedestal shell 10. In the embodiment, the elastic element 40 is a spring of which a middle part has a greater diameter than the ones of two ends.

Figure 3:
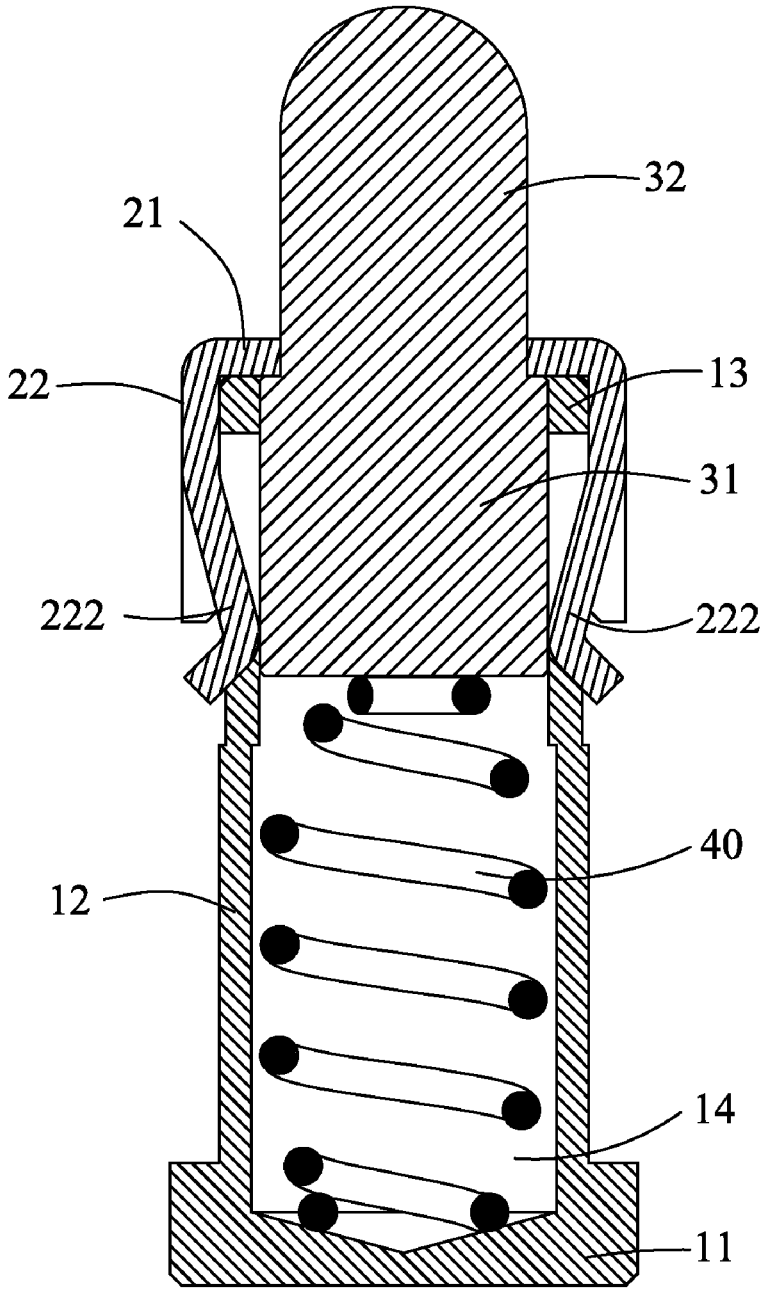
FIG. 3 is a cross-sectional view of the probe connector of FIG. 1.

Referring to FIGS. 1-3, when assembling the probe connector 100, the elastic element 40 is inserted downward in the receiving chamber 14 of the pedestal shell 10 with a bottom end thereof resisting against the top of the pedestal platform 11. The probe pin 30 is assembled upward in the positioning shell 20, with the touching portion 32 passing upward through the through hole 211 to project beyond the blocking plate 21, and the base portion 31 being disposed in the receiving space 23 and having the top thereof abut under the blocking plate 21. The contact arms 222 of the positioning shell 20 resist against a periphery outside of the base portion 31 to clip the base portion 31 therebetween and further achieve an electrical connection with the probe pin 30. Then the positioning shell 20 with the probe pin 30 is coupled to the fastening body 13 of the pedestal shell 10 by means of the SMT machine sucking the blocking plate 21, wherein the side plates 22 abut against the four surfaces 131, and the base portion 31 of the probe pin 30 is inserted in the receiving chamber 14 of the pedestal shell 10. The contact arms 222 further pass through the corresponding windows 1321 to stretch into the receiving chamber 14 and resist against the base portion 31 of the probe pin 30. The buckling blocks 1311 are buckled in the buckling holes 221 to secure the positioning shell 20 with the pedestal shell 10. The blocking plate 21 is against a top of the fastening body 13 to restrain the base portion 31 in the receiving chamber 14. A top end of the elastic element 40 abuts against a bottom of the base portion 31.

In use, the touching portion 32 of the probe connector 100 contacts with a mating terminal (not shown). At this time, the elastic element 40 is pressed by the base portion 31 under the pressure of the mating terminal acting on the touching portion 32. In the process of the touching portion 32 being pressed by the mating terminal to make the base portion 31 slide downward in the receiving chamber 14, the contact arms 222 of the positioning shell 20 always resist against the base portion 31 so as to ensure the electrical connection between the probe pin 30 and the positioning shell 20. When the touching portion 32 is set free, the base portion 31 slides upward under the elasticity of the elastic element 40 until the top of the base portion 31 is blocked by the blocking plate 21 again.

As described above, the probe connector 100 of the present invention utilizes the positioning shell 20 to be removably coupled to the fastening body 13 of the pedestal shell 10 and partially cover the receiving chamber 14, so as to make the base portion 31 of the probe pin 30 movably restrained in the receiving chamber 14. So the probe connector 100 can be easily assembled and disassembled. Furthermore, the contact arms 222 of the positioning shell 20 are designed to always resist against the base portion 31 in the process of the touching portion 32 being pressed by the mating terminal and set free from the mating terminal, so that effectively ensures a steady movement of the base portion 31 in the receiving chamber 14 and further achieves a steadily electrical connection among the probe pin 30, the pedestal shell 10 and the positioning shell 20.

What is claimed is:

1. A probe connector, comprising:

a pedestal shell having a pedestal platform, and a hollow barrel extending upward from a top of the pedestal platform, a receiving chamber being defined among the pedestal platform and the barrel with a top end thereof opened freely, a top end of the barrel protruding outward to form a fastening body, a pair of windows being opened at two opposite parts of the fastening body and penetrating through the fastening body and the barrel to communicate with the receiving chamber;

a positioning shell removably coupled to the fastening body of the pedestal shell, the positioning shell having a blocking plate covered on the top end of the receiving chamber, and side plates extending downward from periphery edges of the blocking plate to abut against outsides of the fastening body, a middle of the blocking plate defining a through hole having a smaller diameter than that of the receiving chamber and coaxial with the receiving chamber, two opposite ones of the side plates being provided with two contact arms each having a top end connected with the side plate, the contact arms extending downward and inclined towards each other to pass through the windows of the pedestal shell respectively and stretch into the receiving chamber, each contact arm having a bottom end thereof bent outward;

a probe pin having a base portion movably disposed in the receiving chamber of the pedestal shell, and a touching portion protruding upward from a middle of a top of the base portion to pass through the through hole of the positioning shell, wherein the contact arms of the positioning shell always resist against the base portion to clip the base portion therebetween in the process of the base portion moving upward and downward in the receiving chamber; and an elastic element assembled in the receiving chamber and between the base portion and the pedestal platform, the top of the base portion resisting against the blocking plate under the elasticity of the elastic element and being blocked under the blocking plate.

2. The probe connector as claimed in claim 1, wherein the windows of the pedestal shell are aligned with each other along a diameter direction of the receiving chamber, and the contact arms of the positioning shell symmetrically resist against the base portion of the probe pin along the diameter direction of the base portion.

3. The probe connector as claimed in claim 1, wherein the fastening body of the pedestal shell has another two opposite parts thereof oppositely protruded outward to form a pair of buckling blocks, the side plates have another two opposite ones each defining a buckling hole for buckling the buckling block therein to secure the positioning shell to the pedestal shell.

4. The probe connector as claimed in claim 3, wherein the fastening body shows a rectangular profile and has four rectangular surfaces connected in succession together, the pair of windows is opened in substantial middles of two opposite ones of the four surfaces, the pair of buckling blocks are protruded at substantial middles of the other two opposite surfaces, the pedestal shell substantially shows a rectangular box-shape.

5. The probe connector as claimed in claim 1, wherein the elastic element is a spring of which a middle part has a greater diameter than the ones of two ends.

* * * * *